United States Patent [19]

Tokura et al.

[11] 4,356,807

[45] Nov. 2, 1982

[54] IGNITION DEVICE FOR AN INTERNAL COMBUSTION ENGINE

[75] Inventors: Norihito Tokura, Okazaki; Hisasi Kawai, Toyohashi; Seiji Morino, Aichi, all of Japan

[73] Assignee: Nippon Soken, Inc., Nishio, Japan

[21] Appl. No.: 181,243

[22] Filed: Aug. 25, 1980

[30] Foreign Application Priority Data

Aug. 31, 1979 [JP] Japan ..... 54-111846

[51] Int. Cl.[3] ..... F02P 3/04

[52] U.S. Cl. ..... 123/606; 123/637; 123/644; 315/209 T

[58] Field of Search ..... 123/606, 637, 644, 621, 123/655; 315/209 T; 331/114

[56] References Cited

U.S. PATENT DOCUMENTS 2,966,615 12/1960 Meyer, Jr. et al. ..... 315/206
3,035,108 5/1962 Kaehni ..... 123/637
3,910,247 10/1975 Hartig ..... 123/655
4,138,977 2/1979 Grather et al. ..... 123/637
4,245,594 1/1981 Morino et al. ..... 123/606

*Primary Examiner*—Charles J. Myhre
*Assistant Examiner*—Andrew M. Dolinar
*Attorney, Agent, or Firm*—Cushman, Darby & Cushman

[57] ABSTRACT

Two closed circuits respectively are each comprised of a primary coil of a transformer for plug ignition, a transistor, a diode, a resistor and a common power source. When one of the transistors is conductive during the ignition period, the current in the related closed circuit increases. When the increased current appearing across the associated resistor exceeds a reference value, the associated comparator renders the conducting transistor nonconductive while it renders the other nonconductive transistor conductive, whereby the transistors continues a push-pull operation at given periods. Each diode is inserted either between the associated primary coil and the associated transistor or between the associated primary coil and the common power source.

5 Claims, 5 Drawing Figures

IGNITION DEVICE FOR AN INTERNAL COMBUSTION ENGINE

BACKGROUND OF THE INVENTION

This application is related to a copending U.S. application Ser. No. 68,735 filed on Aug. 22, 1979, now U.S. Pat. No. 4,245,594, and assigned to the same assignee of this application.

This invention relates to an ignition device and, more particularly, to an ignition device of the AC continuous discharge type for restricting the primary coil current of an ignition coil.

A conventional ignition device for an ignition-type internal combustion engine, having an ignition coil and a breaker, has been constructed on the basis of a principle that magnetic energy previously stored in an ignition coil is supplied to an ignition plug (spark plug) through the secondary coil when the breaker opens. In one combustion stroke of the internal combustion engine, a discharge duration ranges 1 to 2 msec and an average discharge current ranges 20 to 30 mA. Either when the air-fuel mixture is leaned or when the engine is operated in an exhaust gas recirculation (EGR) mode, the conventional device encounters problems of insufficient ignition, deterioration of fuel consumption of the engine, and a large amount of harmful components in exhaust gases.

SUMMARY OF THE INVENTION

Accordingly, an object of the invention is to provide a simplified ignition device with reduced fuel consumption of the engine and reduced harmful exhaust gas components by discharge of an ignition plug for a long period of time in a substantially continuous manner.

Another object of the present invention is to provide an ignition device which will always produce a trigger high voltage stably against a voltage variation of a DC power source and provide a stable discharge of the ignition plug, by controlling an oscillating period so that the maximum value of the current in the primary coil of a transformer corresponding to a conventional ignition coil is always constant.

Other objects and features of the invention will be apparent from the following description taken in connection with the accompanying drawings, in which:

DESCRIPTION OF THE PREFERRED EMBODIMENTS

Figure 1:
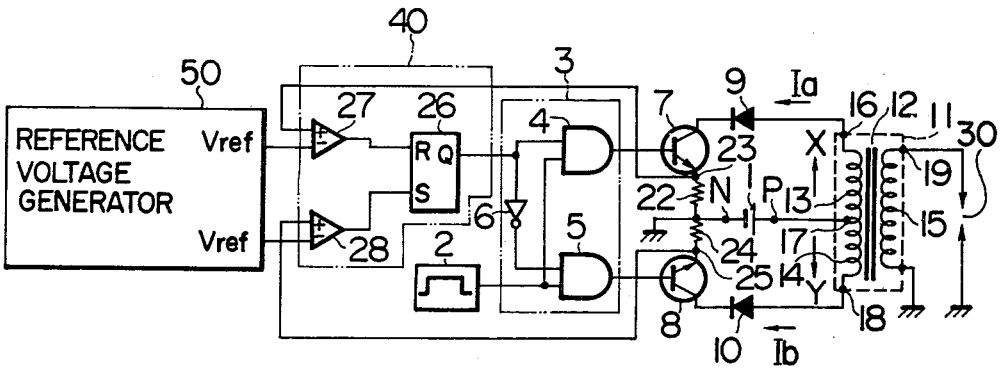
FIG. 1 is a circuit diagram of an embodiment of an ignition device according to the present invention.
Figure 2:
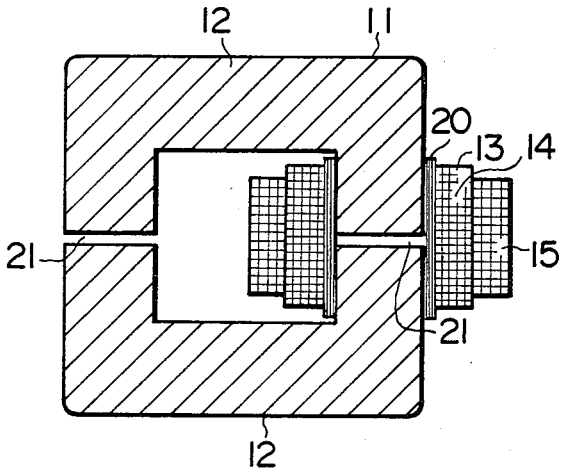
FIG. 2 is a cross section view of a transformer shown in FIG. 1.

The present invention will be described referring to embodiments shown in the drawings. In FIG. 1, reference numeral 1 designates a battery as a DC power source mounted in a car; 2 a signal generator for producing an ignition signal in synchronism with rotation of an engine (not shown); 3 a logic circuit. An AND gate 4 in the circuit 3 performs an AND logic of the output signals from the signal generator 2 and a judging circuit 40. The logic circuit 3 and the judging circuit 40 constitute a control circuit. During a "1" level signal from the signal generator 2, the AND gate 4 permits the output pulse signal from the judging circuit 40 to pass therethrough. On the other hand, during a "0" level signal from the signal generator 2, the AND gate 4 always produces a "0" level signal. An AND gate 5 executes an AND logic of an output signal from the signal generator 2 and an output signal from an inverter 6 for inverting the output signal from the judging circuit 40. During a period that the signal generator 2 produces a "1" level signal, the AND gate 5 permits the output pulse signal from the inverter 6 to pass therethrough. On the other hand, when the signal generator 2 produces a "0" level signal, it always produces a "0" level signal. Reference numerals 7 and 8 are representative of power transistors so connected as to perform a push-pull operation in response to the output signals from AND gates 4 and 5. The base of the transistor 7 is connected to the output terminal of the AND gate 4. The base of the transistor 8 is connected to the output terminal of the AND gate 5. The collectors of the transistors 7 and 8 respectively are connected to the primary terminals 16 and 18 of a transformer 11, through diodes 9 and 10 both serving as reverse current-flow preventive elements, with the collectors facing to the cathodes of the diodes 9 and 10. The emitters of the transistors 7 and 8 are connected to a minus terminal N of the DC power source 1 through respective current detecting resistors 22 and 24 with small resistance. The transformer 11 comprises primary coils 13 and 14 and a secondary coil 15, and a magnetic core 12. The turn ratio of the primary to secondary coils are approximately 100 to 200. The primary and secondary coils are magnetically coupled with each other, through the core 12. The voltages developed in the primary coils 13 and 14 are boosted by the secondary coil 15. The terminals 16 and 18 of the primary coils are respectively connected to the anodes of the diodes 9 and 10 and an intermediate terminal 17 thereof is connected to a plus terminal P of the DC power source. An output terminal 19 of the secondary coil 15 and an ignition plug 30 are connected by a high tension cable. The primary coils 13 and 14 of the transformer 11, and the secondary coil 15 which have been wound around a bobbin 20 are disposed around a pair of U-shaped cores forming a closed magnetic path, as shown in FIG. 2. The magnetic circuit formed by the core includes a pair of gaps 21 each about 0.25 mm, totally about 0.5 mm. An experiment conducted shows that when the turn ratio of the primary and secondary coils is 100, preferably are 20 turns for the primary coil and 2000 turns for the secondary coil.

The judging circuit 40 judges the magnitudes of the primary currents Ia and Ib of the transformer 11 by detecting voltage drops across current detecting resistors 22 and 24. In the judging circuit 40, a dropped voltage across the resistor 20 is applied to the positive input terminal (+) of the comparator 27 and a predetermined reference voltage Vref produced by a reference voltage generator 50 to the negative input terminal (−). The comparator 27 compares the dropped voltage with the predetermined reference voltage Vref produced by the reference voltage gererator 50. When the former is higher than the latter, it produces a "1" level signal. In an inverse case, it produces a "0" level signal. In connection with the comparator 28, a voltage dropped across the resistor 24 is applied to the positive input terminal (+) of the comparator 28. The reference voltage Vref is applied to the negative input terminal (−). When the voltage drop is larger than the reference voltage Vref, the comparator 28 produces a "1" level signal. When the former is smaller than the latter, it produces a "0" level signal. The terminal S of an R-S type flip-flop 26 is a set input terminal, the terminal R is a reset input terminal and the terminal Q is an output terminal. The terminals R and S of the flip-flop 26 are connected to the output terminals of the comparators 27 and 28, respectively. When the comparator 27 produces a "1" level signal, the terminal Q provides a "0" level signal. When the comparator 28 produces a "1" level signal, the terminal Q provides a "1" level signal.

Figure 3:
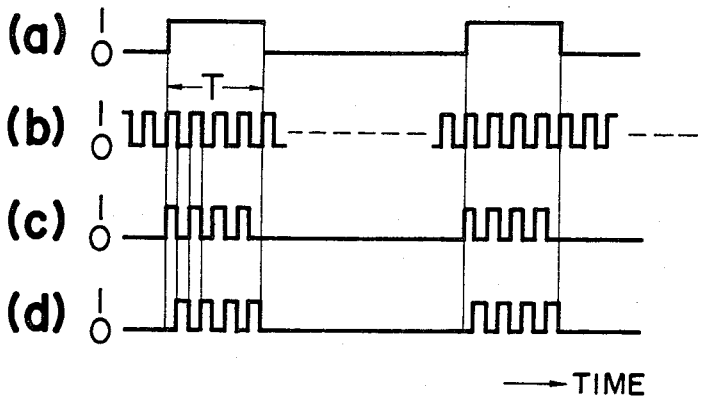
FIGS. 3 and 4 are a set of waveforms useful in explaining the operation of the ignition device according to the present invention.

The operation of the ignition device thus constructed will be described hereinafter. The signal generator 2 producing an ignition signal in synchronism with the rotation of the engine being operated, produces a rectangular pulse signal as shown in FIG. 3(*a*). The signal generator 2 produces a "1" level signal only during the ignition discharge period. The judging circuit 40 produces a rectangular wave pulse signal, as shown in FIG. 3(*b*), with an inherent frequency of 2 to 5 kHz determined by a circuit design including the transformer 11, as described later. The inverter 6 produces a pluse signal as an inversion of the rectangular wave pulse signal. Accordingly, the AND gate 4 produces a composite pulse signal as shown in FIG. 3(*c*). The AND gate 5 produces a composite pulse signal as shown in FIG. 3(*d*). Since the transistors 7 and 8 are turned on and off in response to the output signals of the AND gates 4 and 5, pulse signals with opposite phases respectively are applied to the bases of the transistors 7 and 8 during the period T shown in FIG. 3, whereby the transistors 7 and 8 are repetitively turned on and off alternately.

Figure 4:
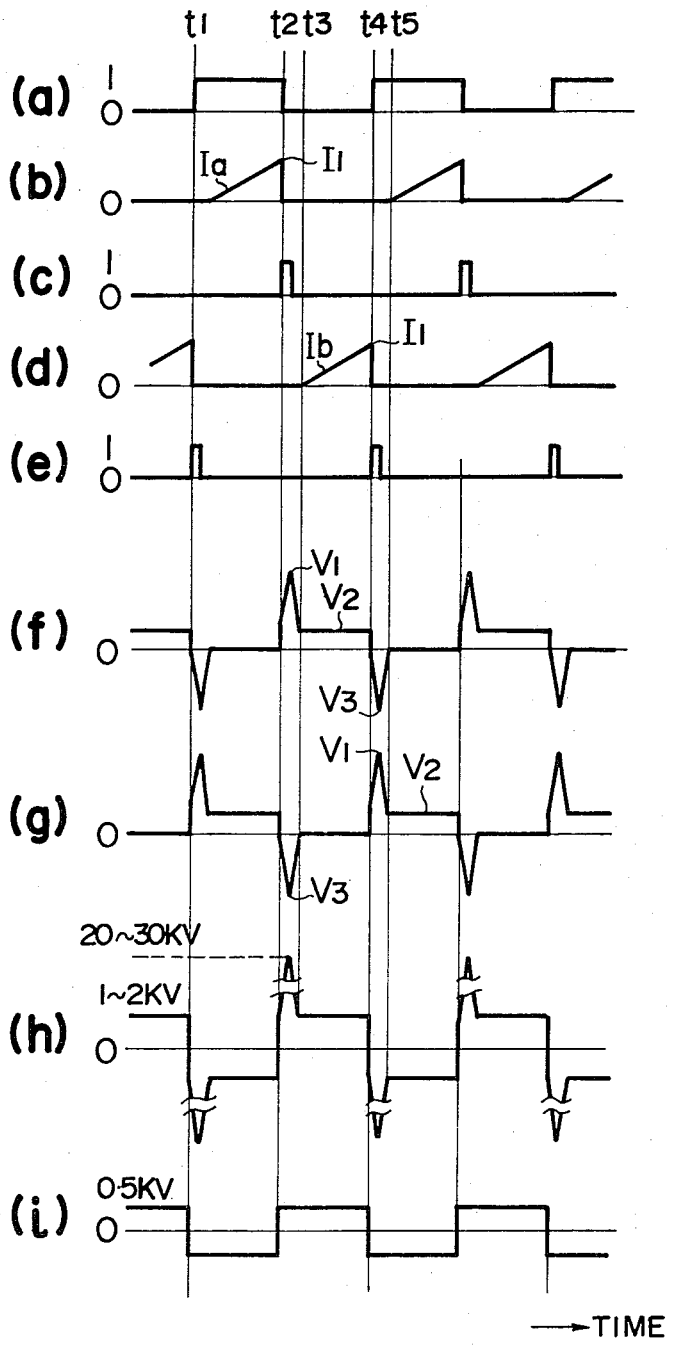

FIG. 4(*a*) shows the waveform shown in FIG. 3(*c*) during the period T of which the time axis is expanded, illustrating the output level at the terminal Q of the flip-flop 26. As seen from FIG. 4, at time t1 when the output at the terminal Q rises from a "0" level to "1" level, the transistor 7 changes from an OFF state to an ON state and the current I*a* flowing through the primary coil 13 increases with time. At time t2 when the current I*a* of the primary coil 13 reaches I1, the voltage drop across the current detecting resistor 22 causes a voltage corresponding to the current I1 to appear at the terminal 23, and the reference voltage Vref is so selected to be equal to the voltage at the terminal 23 at that time. Accordingly, when the voltage at the terminal 23 corresponding to the current Ia after t2 becomes larger than the reference voltage Vref, the output from the comparator 27 changes from "0" level to "1" level at time t2, as shown in FIG. 4(*c*). Then, since the "1" level signal is applied to the terminal R of the flip-flop 26, the output at the terminal Q at time t2 changes from the "1" level to the "0" level, as shown in FIG. 4(*a*), and the transistor 7 changes from the ON state to the OFF state, whereby the current Ia of the primary coil 13 rapidly reduces immediately after a maximum value I1, as shown in FIG. 4(*a*). For this, a counter-electromotive force is produced in the primary coil 13 in an arrowed direction X in FIG. 1, so that a trigger high voltage is produced at the terminal 19 of the secondary coil 15.

After the output of the comparator 27 changes from "0" level to the "1" level at time t2, the current Ia of the primary coil 13 reduces to be smaller than the current I1. As a result, the dropped voltage at the terminal 23 is smaller than the reference voltage Vref and the output of the comparator 27 changes from "1" level to the "0" level. Therefore, the output from the comparator 27 is a short pulsate wave occurring immediately after time t2, as shown in FIG. 4(*c*). At time t3, the transistor 8 and the diode 10 are conductive and the current Ib of the primary coil 14 increases with time, as shown in FIG. 4(*d*). At time t4, when the current Ib of the primary coil 14 reaches the current I1, the voltage dropped across the resistor 24 causes the voltage corresponding to the current I1 to produce at the terminal 25, and the reference voltage Vref is selected to be equal to the voltage at the terminal 25 at that time. Accordingly, after time t4, the dropped voltage at the terminal 25 corresponding to the current Ib becomes larger than the reference voltage Vref, so that the output of the comparator 28 changes from the "0" level to the "1" level at time t4, as shown in FIG. 4(*e*). Then, since the "1" level signal is inputted to the terminal S of the flip-flop 26, the output at the terminal Q changes from the "0" level to the "1" level at time t4, as shown in FIG. 4(*a*), and the transistor 8 changes from the ON state to the OFF state. Accordingly, the current Ib of the primary coil 14 rapidly reduces immediately after it takes a maximum value I1, as shown in FIG. 4(*d*). In the primary coil 14, a counter-electromotive force in an arrowed direction Y in FIG. 1 is produced, so that a trigger high voltage is induced in the terminal 19 of the secondary coil 15. Immediately after the output from the comparator 28 changes from the "0" level to the "1" level, the current Ib of the primary coil 14 reduces to be smaller than the current I1 and the dropped voltage at the terminal 25 becomes smaller than the reference voltage Vref. As a result, the output from the comparator 28 changes from the "1" level to the "0" level. Accordingly, the output signal from the comparator 28 is a short pulsate wave produced immediately after time t4, as shown in FIG. 4(*e*). At time t5, the transistor 7 and the diode 9 are rendered conductive, and the current Ia increases, as shown in FIG. 4(*b*). In this way, the judging circuit 40 continuously produces a pulse signal with an inherent frequency of 2 to 5 kHz, as shown in FIG. 3(*b*).

In this embodiment, the diode 10 is connected between the terminal 18 and the collector of the transistor 8. The diode 10 does not absorb a negative pulse high voltage to block the conduction of the base and collector path of the transistor 8. For this, a negative pulse high voltage V3 shown in FIG. 4(*g*) is produced at the terminal 18 at time t2. On the other hand, a positive pulse high voltage V1 shown in FIG. 4(*f*) is produced at the terminal 16. Then, the voltage at the terminal 16 reduces to a voltage V2 approximately two times of the power source voltage at time t3. After a negative pulse voltage V3 appears at the terminal 18 of the primary coil 14, as shown in FIG. 4(*b*), the voltage rises up to about earth potential at time t3. Accordingly, the diodes 10 at time t3 is in the ON state in the forward direction. Further, the transister 8 had be in the ON state at time t2. Under this condition, the current Ib starts to flow into the primary coil 14, having a current waveform as shown in FIG. 4(*d*). The current passage in the primary coil 14 keeps the voltage at the terminal 16 substantially at V2.

At time t4, when the output signal from the AND gate 4 rises from the "0" level to the "1" level, the transistor 7 shifts from the OFF state to the ON state while the transistor shifts from the ON state to the OFF state. At time t4, when the transistor 8 becomes in the OFF state, the current Ib of the primary coil 14 rapidly reduces immediately after it takes a maximum value T1. As a result, a counter-electromotive force is produced in the primary winding 14, having a direction of an arrow Y in FIG. 1. The counter electromotive force appears as a positive pulse high voltage at the terminal 18 while it appears as a negative pulse high voltage at the terminal 16.

Further, the diode 9 is connected between the terminal 16 and the collector of the transistor 7. The diode 9 does not absorb the negative pulse high voltage for blocking the conduction of the base-collector path of the transistor 7, so that a negative pulse high voltage V3 shown in FIG. 4(*h*) appears at the terminal 16 while a positive pulse high voltage V1 shown in FIG. 4(*g*) appears at the other terminal 18. Then, the voltage at the terminal 18 reduces up to the voltage V2 approximately two times the power source voltage at time t5. After the negative pulse high voltage V3 appears at the terminal 16 of the primary coil 13, as shown in FIG. 4(*f*), the voltage rises up to approximately earth voltage at time t5. Accordingly, at time t5 the diode 9 is forwardly biased and in the ON state. At this time, the transistor 7 has been in the ON state. Therefore, the current Ia starts to flow into the primary coil 13, having a waveform shown in FIG. 4(*b*). The current passage of the primary coil 13 keeps the potential at the terminal 18 substantially at the potential of the terminal 18.

Subsequently, the above-mentioned operation is repeated thereby to produce voltages with waveforms as shown in FIGS. 4(*f*) and 4(*g*) at the terminals 16 and 18 of the primary coils. The secondary voltage boosted is induced corresponding to the primary voltage and appears at the terminal 19 of the secondary coil 15, and then is applied to the ignition plug 30. At no load where the ignition plug 30 is not connected to the terminal 19 of the secondary coil 15, the secondary voltage has a waveform as shown in FIG. 4(*h*). When the ignition plug 30 is connected to the terminal 19, the secondary voltage has a waveform as shown in FIG. 4(*g*).

As seen from the foregoing description, the ignition plug 30 performs a capacitive discharge by the secondary trigger high voltage corresponding to the primary voltage V1. In accordance with the principle of the transformer, subsequently, the discharge lasts for a long time with a secondary voltage which is lower than a trigger high voltage corresponding to the primary voltage V2 but is enough to keep the discharge. Note here that since the trigger high voltage and the subsequent continuous discharge voltage are alternately produced, even if mixture flow within the combustion chamber of the engine causes the discharge of the ignition plug 30 to temporarily cease, the next trigger high voltage swiftly restores the discharge operation to continue the discharge.

Figure 5:
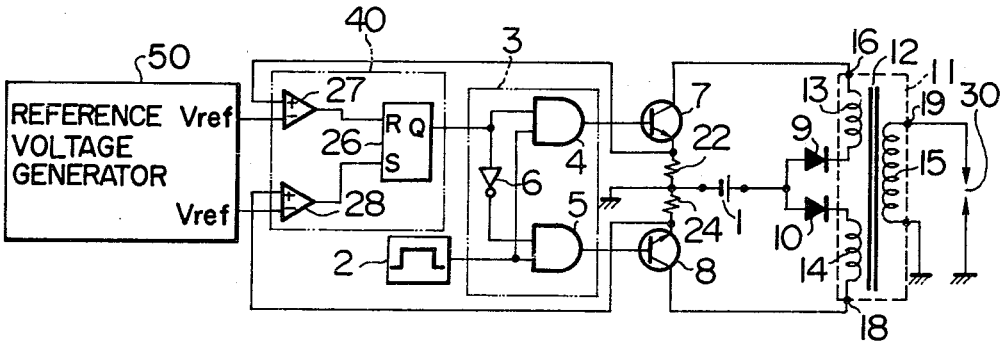
FIG. 5 is a circuit diagram of another embodiment of the ignition device according to the present invention.

In the above embodiment, the diodes 9 and 10 are inserted between the transistors 7 and 8 and the primary coils 16 and 18, respectively. As shown in FIG. 5, the insertion of them to the portion of the middle terminal may block the primary coil current arising from a counter-electromotive force developed in a pair of the primary coils 13 and 14. The same effects attained by using the diodes 9 and 10 in the above-mentioned embodiment may be attained.

We claim:

1. An ignition arrangement for an internal combustion engine having an electrical power source, comprising:

an ignition transformer having first and second primary coils and a secondary coil;

a spark plug coupled to said secondary coil for igniting said engine in response to a voltage induced in said secondary coil by a current flowing in either of said primary coils;

a first switching element, a first diode and a first current sensing resistor connected in series with said first switching element forming a first circuit for (a) coupling power from said power source to said first primary coil when the first switching element is closed and (b) preventing a flow of power from the power source to said first primary coil when the first switching element is open;

a second switching element, a second diode and a second current sensing resistor connected in series with said second switching element forming a second circuit for (c) coupling power from said power source to said second primary coil when the second switching element is closed and (d) preventing a flow of power from the power source to said second primary coil when the second switching element is open;

means for generating a signal synchronized with the rotation of said engine; and a control circuit having inputs coupled to said generating means and to said current sensing resistors for controlling the switching of said first and second switching elements by providing an OFF-ON repetitive signal to one of said switching elements and an ON-OFF repetitive signal to the other of said switching elements so as to operate said switching elements in push-pull, the ON and OFF intervals of the repetitive signals being controlled as a function of the current flowing in said first and second circuits and the signal provided by the generating means so that current flow in one of the circuits is shut-off when the magnitude of current flow in that circuit reaches a predetermined value and simultaneously the other circuit is switched so that current will flow therein, the alternating current flows through the first and second circuits and their respective primary coils inducing a voltage in the secondary coil.

2. An arrangement according to claim 1 wherein each diode is coupled between its respective switching element and an end of its respective primary coil.

3. An arrangement according to claim 1 wherein each diode is coupled between the power source and an end of its respective primary coil.

4. An arrangement according to claim 1, 2 or 3 wherein the control circuit includes a judging circuit comprising:

a first comparator for comparing a voltage drop across said first current sensing resistor indicative of current flowing through the first circuit with a first reference voltage generated by a means for providing a first reference voltage;

a second comparator for comparing a voltage drop across said second current sensing resistor indicative of current flowing through the second circuit with a second reference voltage generated by a means for providing a second reference voltage; and a flip flop element having a reset input coupled to an output of said first comparator and a set input coupled to an output of said second comparator for generating a signal indicating when the current in each circuit reaches said predetermined value.

5. An arrangement according to claim 4 wherein the control circuit further includes a logic circuit comprising:

an inverter having an input coupled to the output of said flip-flop element;

first gate means having a first input coupled to the output of said flip-flop element and a second input coupled to said generating means for coupling the output from said flip-flop element to said first switching element in response to said engine rotation synchronized signal; and second gate means having a first input coupled to an output of said inverter and a second input coupled to said generating means for coupling the output from said flip-flop element to said second switching element in response to said engine rotation synchronized signal.

* * * * *